US012178372B2

(12) United States Patent
Davila et al.

(10) Patent No.: US 12,178,372 B2
(45) Date of Patent: Dec. 31, 2024

(54) FLOOR CLEANER

(71) Applicant: Techtronic Floor Care Technology Limited, Tortola (VG)

(72) Inventors: Rafael Davila, Kannapolis, NC (US); Michael Dawson, Huntersville, NC (US); Robert McRorie, Huntersville, NC (US); Donald Lydic, Mooresville, NC (US); Nicholas DeBlasio, Waxhaw, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 18/460,964

(22) Filed: Sep. 5, 2023

(65) Prior Publication Data

US 2024/0065507 A1 Feb. 29, 2024

Related U.S. Application Data

(63) Continuation of application No. 17/224,989, filed on Apr. 7, 2021, now Pat. No. 11,744,426.

(60) Provisional application No. 63/006,892, filed on Apr. 8, 2020.

(51) Int. Cl.
*A47L 11/30* (2006.01)
*A47L 11/40* (2006.01)

(52) U.S. Cl.
CPC ..... *A47L 11/302* (2013.01); *A47L 11/4011* (2013.01); *A47L 11/4016* (2013.01); *A47L 11/4041* (2013.01); *A47L 11/4083* (2013.01); *A47L 11/4088* (2013.01)

(58) Field of Classification Search
None
See application file for complete search history.

(56) References Cited

U.S. PATENT DOCUMENTS

| | | | |
|---|---|---|---|
| 3,761,987 | A | 10/1973 | Nayfa et al. |
| 3,774,262 | A | 11/1973 | Anthony et al. |
| 4,498,214 | A | 2/1985 | Oxel |
| 5,018,240 | A | 5/1991 | Holman |
| 5,241,724 | A | 9/1993 | Lim |
| 5,287,591 | A | 2/1994 | Rench et al. |
| 5,515,568 | A | 5/1996 | Larson et al. |
| 5,697,119 | A | 12/1997 | Mussalo |
| 6,662,402 | B2 | 12/2003 | Giddings et al. |
| 7,685,671 | B2 | 3/2010 | Jansen |
| 7,836,544 | B2 | 11/2010 | Jansen |

(Continued)

FOREIGN PATENT DOCUMENTS

| | | |
|---|---|---|
| DE | 202017107509 U1 | 3/2018 |
| EP | 2335545 A2 | 6/2011 |

OTHER PUBLICATIONS

Examination Report No. 1 issued by the Australian Government for Application No. 2021251178 dated Oct. 9, 2023 (3 pages).

(Continued)

*Primary Examiner* — Bryan R Muller
*Assistant Examiner* — Dana Lee Poon
(74) *Attorney, Agent, or Firm* — Michael Best & Friedrich LLP

(57) ABSTRACT

A floor cleaner including a including a body, a cleaning head pivotally coupled to the body, and a liquid distribution system. The cleaning head includes a first and a second cleaning roller for contacting a surface to be cleaned.

20 Claims, 13 Drawing Sheets

(56) References Cited

U.S. PATENT DOCUMENTS

| | | | | |
|---|---|---|---|---|
| 7,904,990 | B1 * | 3/2011 | Miner | A47L 11/4044 15/320 |
| 2005/0132524 | A1 * | 6/2005 | Parr | A47L 11/4088 15/320 |
| 2007/0214595 | A1 | 9/2007 | Grove | |
| 2008/0148512 | A1 | 6/2008 | Beskow et al. | |
| 2011/0146720 | A1 | 6/2011 | Huffman | |
| 2014/0033469 | A1 * | 2/2014 | Toole | A47L 9/0686 15/415.1 |
| 2019/0000292 | A1 | 1/2019 | Rufenach et al. | |
| 2020/0060498 | A1 | 2/2020 | Bradley et al. | |
| 2020/0154968 | A1 * | 5/2020 | Terry | A47L 9/2847 |
| 2020/0196818 | A1 * | 6/2020 | Verhasselt | A47L 11/201 |

OTHER PUBLICATIONS

Invitation to Pay Additional Fees for Application No. PCT/US2021/026272 dated Jun. 25, 2021 (12 pages).
International Search Report and Written Opinion for Application No. PCT/US2021/026272 dated Aug. 18, 2021 (17 pages).

* cited by examiner

FLOOR CLEANER

CROSS-REFERENCE TO RELATED APPLICATIONS

This application is a continuation of U.S. patent application Ser. No. 17/224,989, filed Apr. 7, 2021, which issued as U.S. Pat. No. 11,744,426 on Sep. 5, 2023, which claims priority to U.S. Provisional Patent Application No. 63/006,892, filed Apr. 8, 2020, the entire contents of which are hereby incorporated by reference herein.

BACKGROUND

The present invention relates to cleaning heads for floor cleaners.

SUMMARY

In one embodiment a floor cleaner is disclosed including a body, a cleaning head, a first cleaning roller, a second cleaning roller, at least one drive assembly, a liquid distribution system, and a recovery reservoir. The cleaning head is pivotally connected to the body. The cleaning head has a first side, a second side, and two lateral sides. The first cleaning roller and the second cleaning roller are operatively positioned on the cleaning head, extending longitudinally between the two lateral sides. The first cleaning roller is parallel to the second cleaning roller. The drive assembly is configured to rotate at least one of the first cleaning roller and the second cleaning roller. The liquid distribution system includes a supply tank, a first dispensing member, and a second dispensing member. The first dispensing member is in fluid communication with the supply tank and is configured to deliver solution to a surface to be cleaned in a first direction beyond the first side of the cleaning head. The second dispensing member is in fluid communication with the supply tank and is configured to deliver solution to the surface to be cleaned in a second direction beyond the second side of the cleaning head. The recovery reservoir is configured to receive the solution extracted from the surface to be cleaned.

In another embodiment a floor cleaner is disclosed including a body, a cleaning head pivotally connected to the body, a first cleaning roller, a second cleaning roller, a suction nozzle, a drive assembly, a suction source, and a recovery tank. The cleaning head is movable along a surface to be cleaned. The first cleaning roller is operatively positioned on the cleaning head. The second cleaning roller is spaced from and parallel to the first cleaning roller operatively positioned on the cleaning head. The suction nozzle is disposed between the first cleaning roller and the second cleaning roller. The suction nozzle has an inlet opening extending longitudinally along the first cleaning roller, with the inlet opening facing the first cleaning roller. The drive assembly is operatively connected to and configured to rotate at least one of the first cleaning roller or the second cleaning roller. The suction source is in fluid communication with the nozzle inlet opening. The recovery tank is in fluid communication with the suction nozzle and the suction source and is configured to receive fluid drawn through the nozzle inlet opening.

In another embodiment a floor cleaner includes a body and a cleaning head pivotally connected to the body. The cleaning head having a first side, a second side opposite the first side, and two lateral sides extending between the first and second sides. The cleaning head further including a first surface cleaning member adjacent the first side and a second surface cleaning member adjacent the second side. A liquid distribution system includes a supply tank, a first dispensing member in fluid communication with the supply tank, and a second dispensing member in fluid communication with the supply tank. The first dispensing member is configured to deliver solution to a surface to be cleaned in a first direction beyond the first side of the cleaning head and the second dispensing member is configured to deliver solution to the surface to be cleaned in a second direction beyond the second side of the cleaning head. The cleaning head is configured to deliver solution through the first dispensing member when the body is pivoted toward the second side of the cleaning head and configured to deliver solution through the second dispensing member when the body is pivoted towards the first side of the cleaning head.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
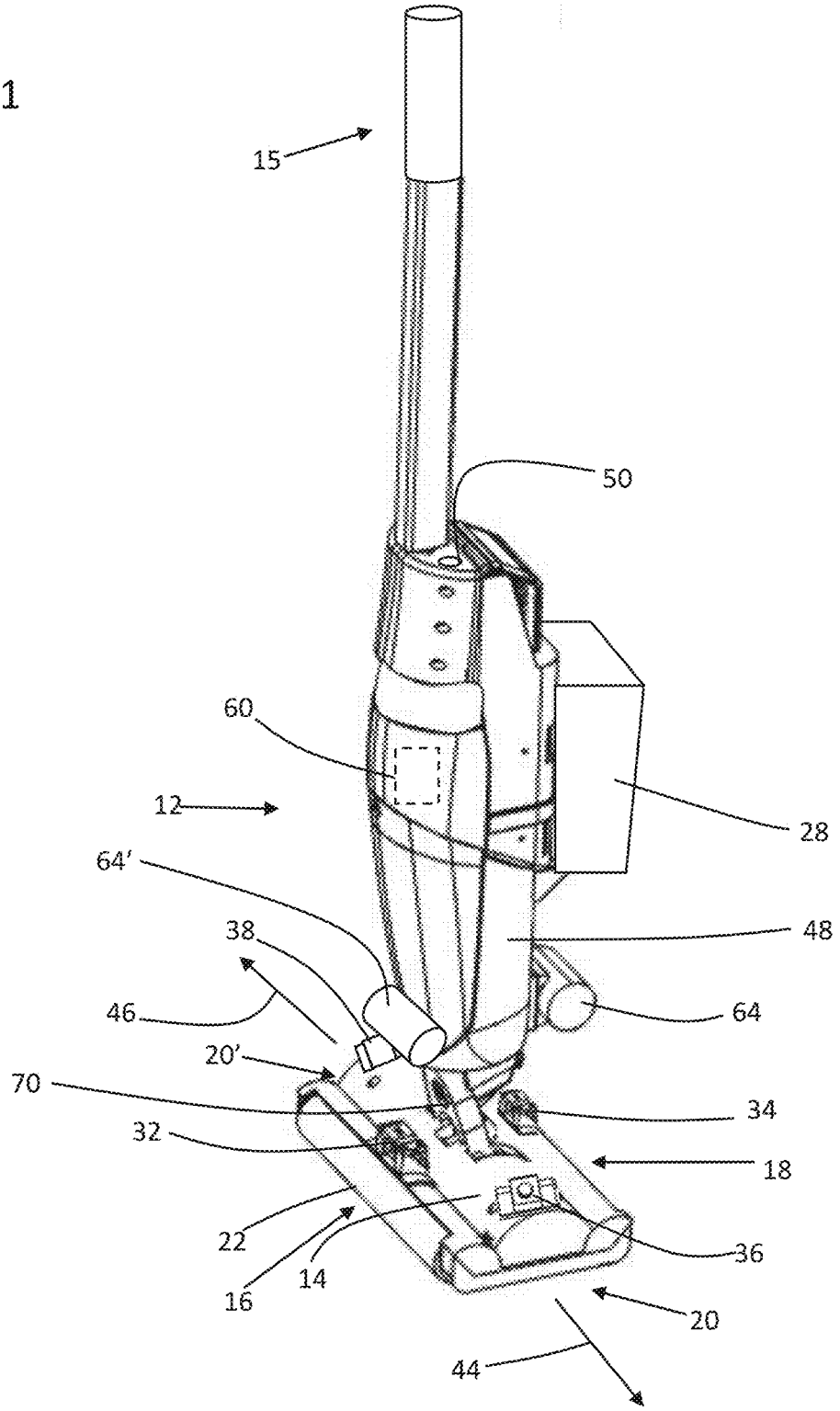
FIG. 1 is a perspective view of a floor cleaner according to one embodiment, shown as a functional schematic.

FIG. 1 illustrates one embodiment of the invention including a floor cleaner 10 having a body 12, a handle 15 on the body 12, and a cleaning head 14. The cleaning head 14 has a first side 16, a second side 18 opposite the first side 16, and two lateral sides 20 and 20'. The cleaning head 14 further includes a first surface cleaning member 22 and a second surface cleaning member 24. In the illustrated embodiment, the first surface cleaning member is a cleaning roller 22 and the second surface cleaning member is a cleaning roller 24 that are both operatively positioned on the cleaning head 14 and extend longitudinally between the two lateral sides 20, 20'. The second cleaning roller 24 is spaced from, and parallel to, the first cleaning roller 22. In one embodiment, the floor cleaner 10 is supported from the surface to be cleaned by the first cleaning roller 22 and the second cleaning roller 24. In other embodiments, the surface cleaning members 22, 24 can include other suitable types of surface cleaning members, including pads, microfiber pads and mops, dust mops, dry or wet wipes, microfiber pads, wet mops, and the like or combinations thereof.

The cleaning head 14 is pivotally connected to the body 12 and is configured to be movable along a surface to be cleaned. The cleaning head 14 is pivotally connected to the body 12 such that the body 12 pivots about a first pivot axis 100 (FIG. 5) oriented along the direction of the first and second cleaning rollers 22 and 24 and disposed between the first cleaning roller 22 and the second cleaning roller 24. The body 12 may further include a connecting member 70 attached to the cleaning head 14, pivotable about the first pivot axis 100, and wherein an upper portion of the body 12 pivots relative to the connecting member 70 about a second pivot axis 200 (FIG. 6) transverse to the first pivot axis 100.

Figure 2:
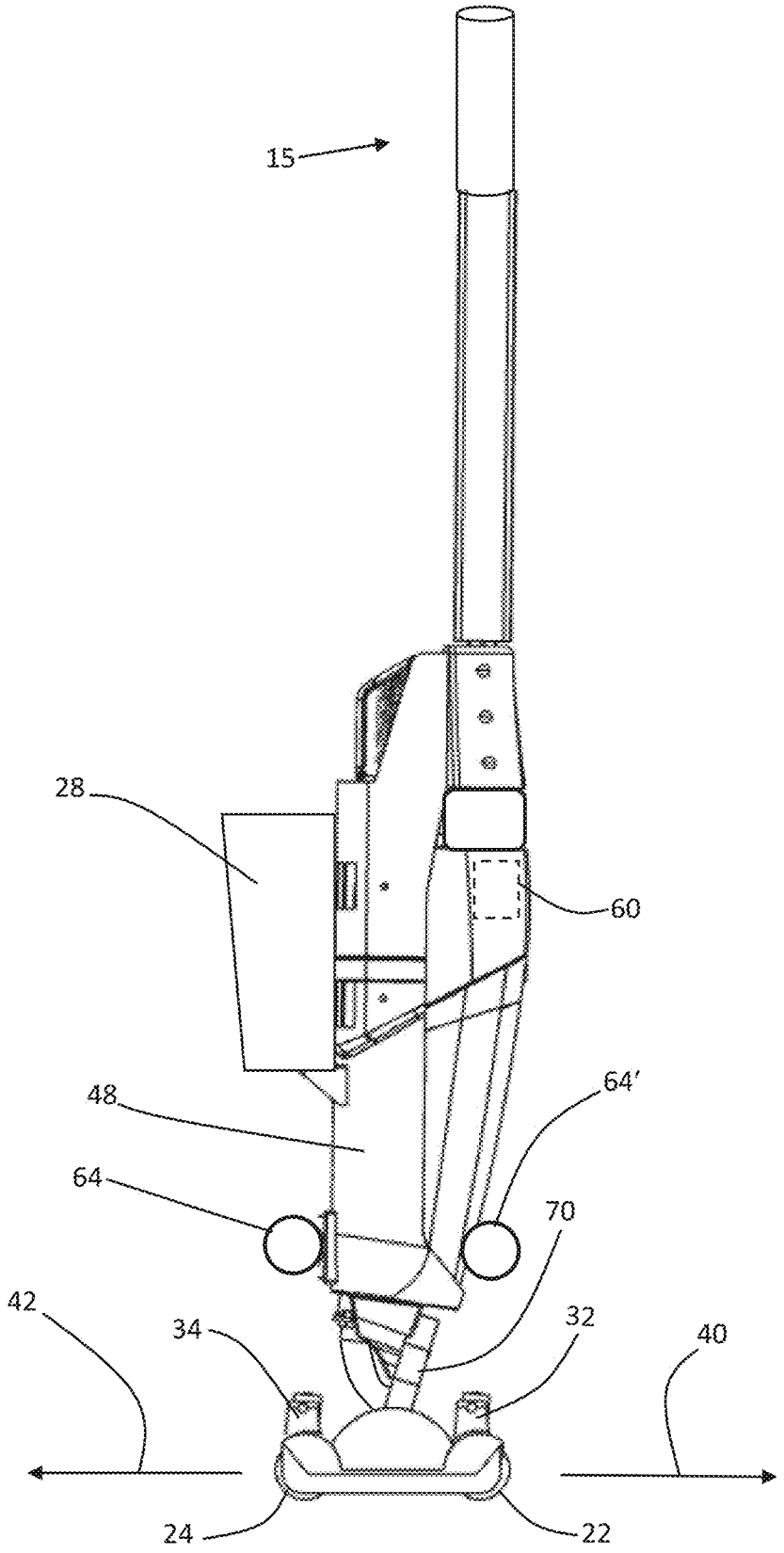
FIG. 2 is a side view of the floor cleaner of FIG. 1.
Figure 3:
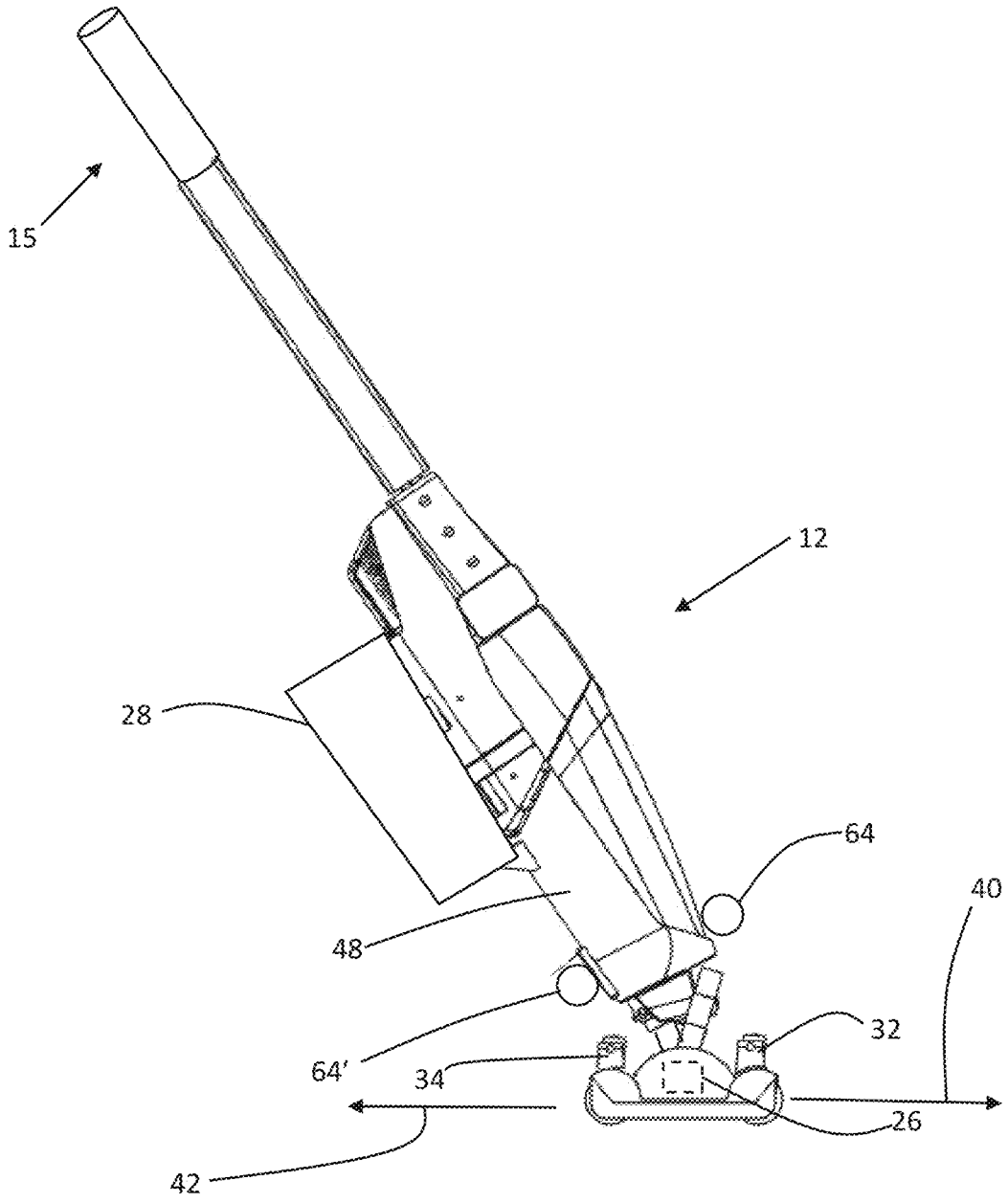
FIG. 3 is a side view of the floor cleaner of FIG. 1 shown in a reclined position, shown as a functional schematic.
Figure 4:
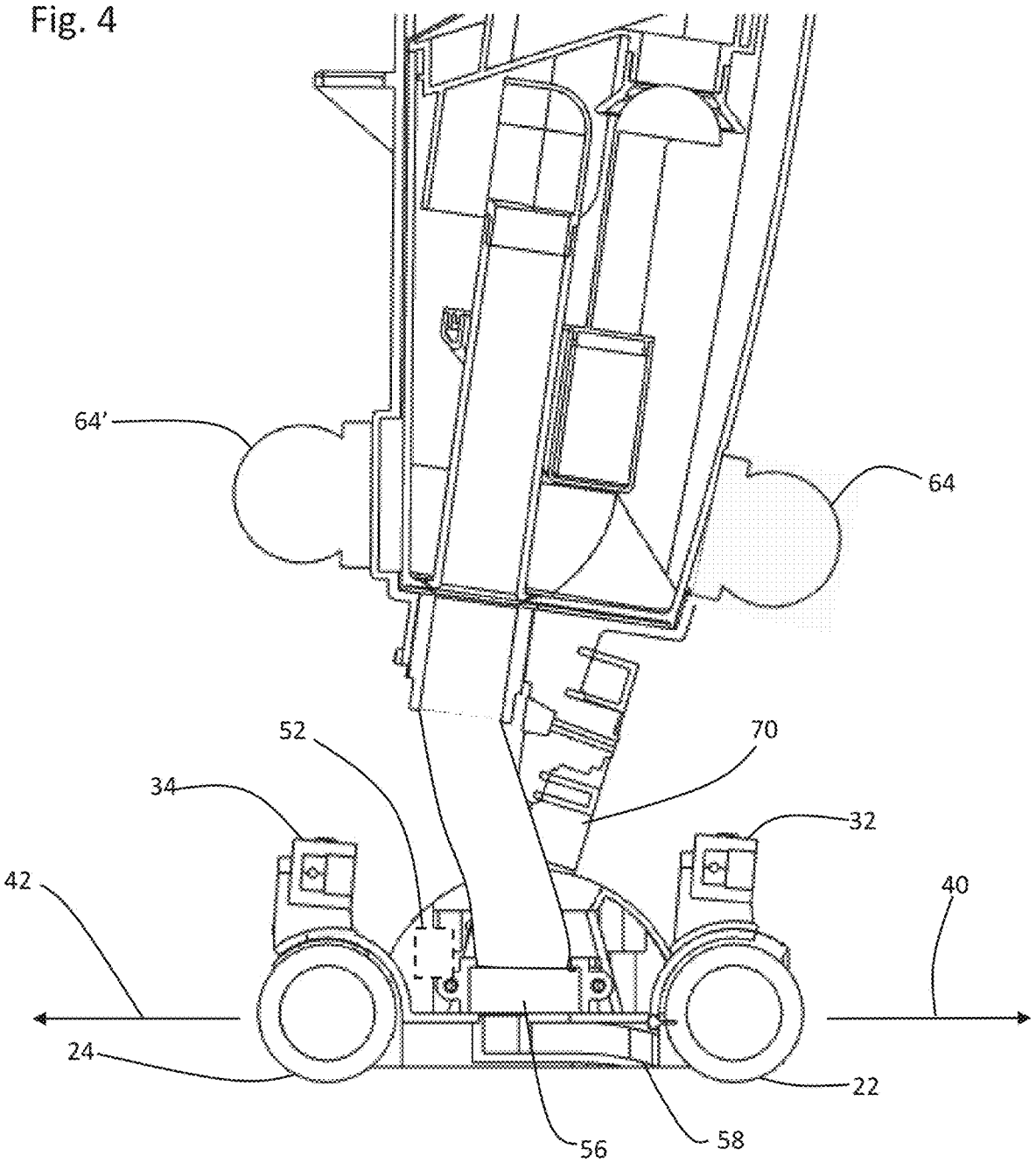
FIG. 4 is a cross-sectional view of the floor cleaner of FIG. 2.
Figure 6:
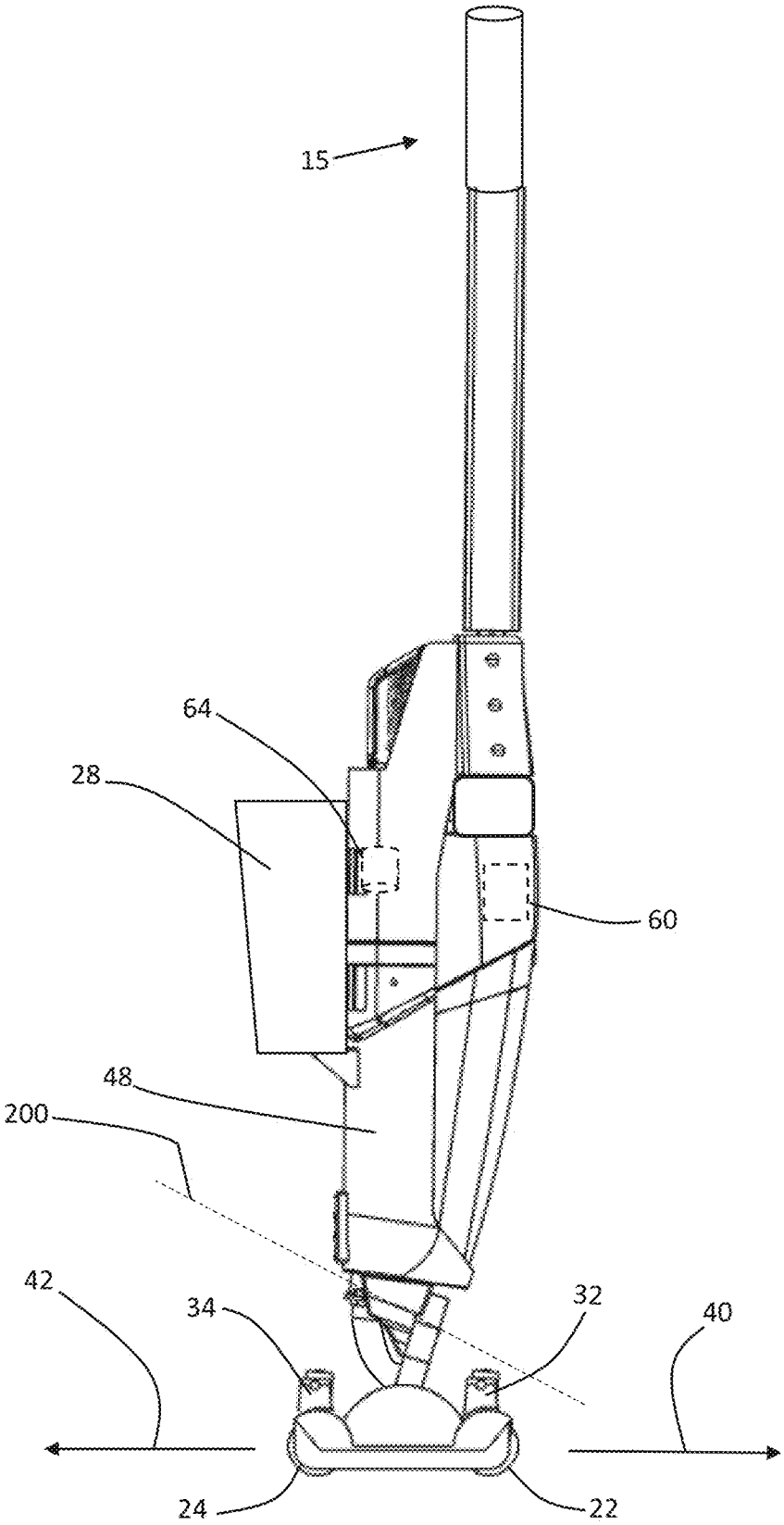
FIG. 6 is a side view of the floor cleaner of FIG. 5.

FIGS. 2, 4, and 6 illustrate the movement of the floor cleaner in a first direction 40 and a second direction 42, opposite the first direction 40. Movement of the floor cleaner 10 in the first direction 40 occurs when the cleaning head 14 is moved in the direction of the first cleaning roller 22 e.g. where the first cleaning roller 22 leads in the direction movement. Movement of the floor cleaner 10 in the second direction 42 occurs when the cleaning head 14 is moved in the direction of the second cleaning roller 24 e.g. where the second cleaning roller 24 leads in the direction of movement. When the body 12 is pivoted about the first pivot axis 100 toward the second side 18 of the cleaning head, the floor cleaner 10 can be pushed by the user in the first direction 40 (FIG. 3) or pulled by the user in the second direction 42. When the body 12 is pivoted about the first pivot axis 100 toward the first side 16 of the cleaning head, the floor cleaner 10 can be pushed by the user in the second direction 42 or pulled by the user in the first direction 40.

The body 12 may also be pivoted about the second pivot axis 200 toward the second lateral side 20' of the cleaning head, allowing the floor cleaner 10 to be pushed by the user in a third direction 44 or pulled by the user in a fourth direction 46. When the body 12 is pivoted about the second pivot axis 200 toward the first lateral side 20 of the cleaning head, the floor cleaner 10 may be pushed by the user in the fourth direction 46 or pulled by the user in the third direction 44. The first pivot axis 100 and the second pivot axis 200 allow the user to move the floor cleaner 10 in the direction of any of the sides of the cleaning head 14 for greater cleaning flexibility and efficiency.

The floor cleaner 10 further includes a liquid distribution system 30 configured to supply a liquid to the surface to be cleaned. The liquid distribution system 30 includes a supply tank 28 configured to contain a liquid such as cleaning fluid, a first dispensing member 32 in fluid communication with the supply tank 28, and a second dispensing member 34 in fluid communication with the supply tank 28. The dispensing members 32 and 34 may be positioned on the cleaning head 14 or on the body 12 of the floor cleaner 10. The cleaning fluid such as water and/or detergent flow through tubing from the supply tank 28 to the first dispensing member 32 or the second dispensing member 34 for dispensing to the surface to be cleaned. The liquid distribution system 30 may include a pump 64 that is configured to pump the cleaning fluid from the supply tank 28 to the one or more dispensing members. The pump 64 may be user operable so that a user can control dispensing of liquid from the dispensing members via an actuator 50. The actuator 50 may be provided in the form of a trigger, a switch, a pushbutton, or a dial, such that user activation of the actuator 50 actuates the pump 64 to dispense the liquid. As discussed further below, in one embodiment, the actuator 50 is operatively connected to a controller 72. The actuator 50 is configured to provide a signal to the controller 72 and the controller 72 is operatively connected the pumps 64, 64' of the fluid distribution system 30.

In one embodiment, the first dispensing member 32 is positioned on the first side 16 of the cleaning head 14 and is configured to deliver liquid to the surface to be cleaned in the first direction 40. The second dispensing member 34 is positioned on the second side 18 of the cleaning head 14 and is configured to deliver solution to the surface to be cleaned in the second direction 42. In the embodiment illustrated in FIG. 1, the floor cleaner 10 may further include a third dispensing member 36 and a fourth dispensing member 38, both in fluid communication with the supply tank 28. The third dispensing member 36 is configured to provide liquid distribution in the third direction 44. The fourth dispensing member 38 is configured to provide liquid distribution in the fourth direction 46. This allows liquid distribution in any direction of the floor cleaner 10 to maximize cleaning efficiency. Specifically, the third dispensing member 36 and fourth dispensing member 38 allow the user to dispense liquid when one of the lateral sides 20, 20' is in the direction of movement, for example to clean in a more narrow space, enabling the user to effectively clean between furniture and in small areas, such as bathrooms or kitchens.

In various alternatives, the flow from the supply tank 28 and the pump 64 may be selectively distributed to a selected dispensing member by one or more valves or valve assemblies 52. In some embodiments, the pump 64 may be fluidly located between the supply tank 28 and the valve 52. By fluidly located it is meant that fluid passes from the supply tank 28 to the pump 64 and then to the valve 52. The valve or valves 52 are configured to regulate the flow of liquid from the supply tank 28 to the dispensing members 32, 34, 36, 38. The valve or valves 52 may be located in the cleaning head 14, as shown schematically in FIGS. 4 and 7. Alternatively, in some embodiments the valve or valves 52 may be located elsewhere, for example, the valve 52 may be located in the body 12 of the floor cleaner, or in or adjacent to the supply tank 28 or the pump 64.

The valve assembly 52 includes a body and a valve member. The valve member is movable relative to the body between a first position and a second position. The member also defines a flow path which extends along or through a surface of the member configured to direct the flow of fluid through the valve 52 in a first flow path when the member is in the first position and in a second flow path when the member is in the second position.

Figure 5:
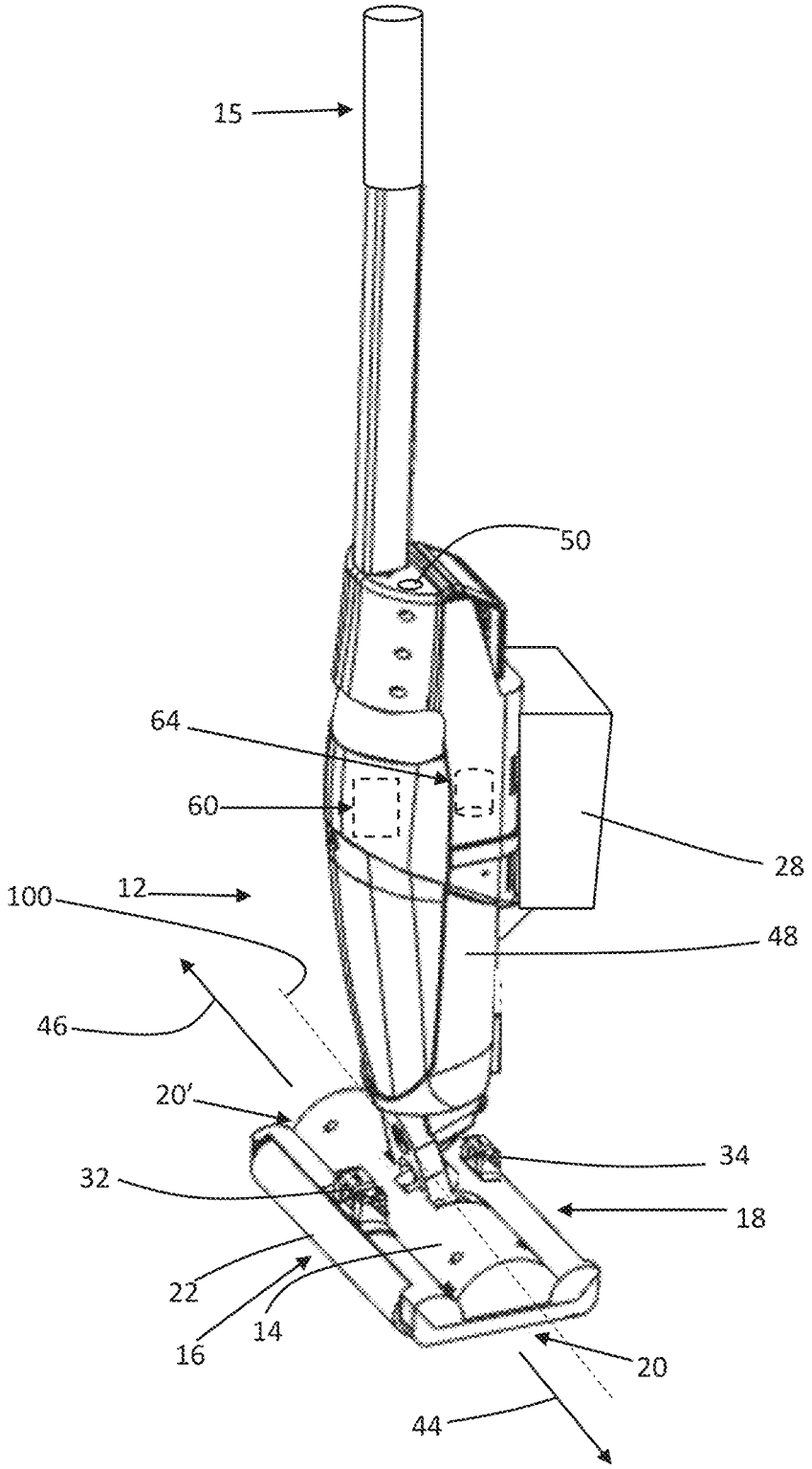
FIG. 5 is a perspective view of a floor cleaner according to one embodiment, shown as a functional schematic.
Figure 8:
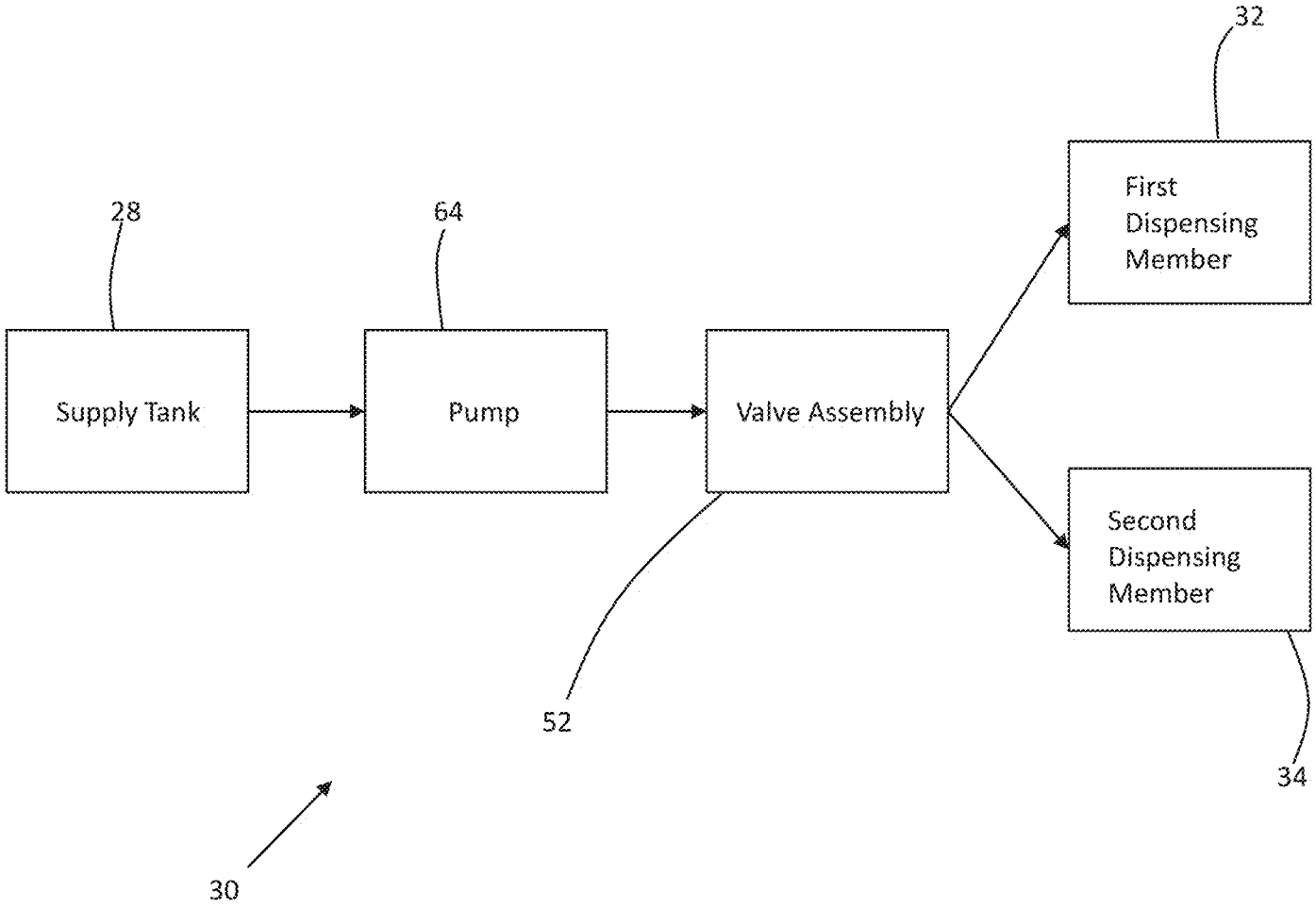
FIG. 8 is a schematic flow diagram of a liquid distribution system of a floor cleaner.

In the embodiment shown in FIGS. 5 and 6, the floor cleaner 10 includes the pump 64. The pump 64 is in fluid communication with valve 52. Valve 52 is configured to selectively regulate flow from the pump 64 to the first dispensing member 32 and the second dispensing member 34. The valve 52 is actuatable to move the member between its first and second positions. As shown schematically in FIG. 8, a first fluid passage is provided between the supply tank 28 and the pump 64. A second fluid passage is provided between the pump 64 and the first valve 52. A third fluid passage is provided between the first valve 52 in the valve first position and the first dispensing member 32. A fourth fluid passage is provided between the first valve 52 in the valve second position and the second dispensing member 34. The valve 52 is configured to selectively direct a flow of fluid through the valve 52 to the first dispensing member 32 when the member is in its first position and the second dispensing member 34 when the member is in its second position.

Figure 10:
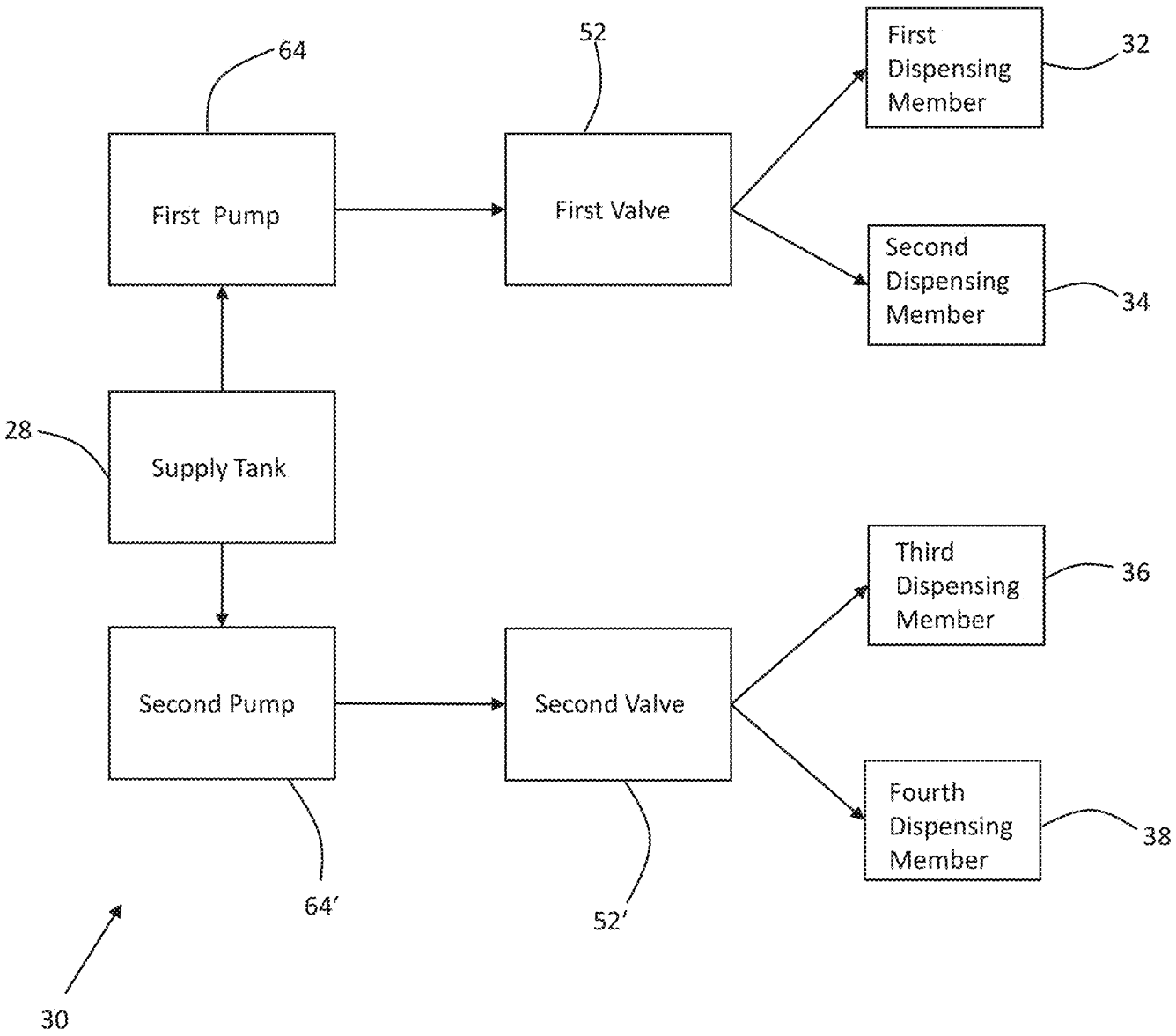
FIG. 10 is a schematic flow diagram of an alternative liquid distribution system of a floor cleaner.

In the embodiment illustrated in FIGS. 1-4, the floor cleaner 10 includes a first pump 64 and a second pump 64'. The first pump 64 delivers fluid to the first and second dispensing members 32, 34 as discussed with respect to FIGS. 5 and 6. As shown schematically in FIG. 10, the second pump 64' is in fluid communication with a second valve 52'. The second valve 52' is configured to selectively regulate flow from the second pump 64' to the third dispensing member 36 and the fourth dispensing member 38. The second pump 64', in conjunction with the second valve 52', allows the floor cleaner 10 to distribute fluid to the lateral sides 20 and 20' in the third direction 44 and the fourth direction 46 of the floor cleaner 10.

Figure 9:
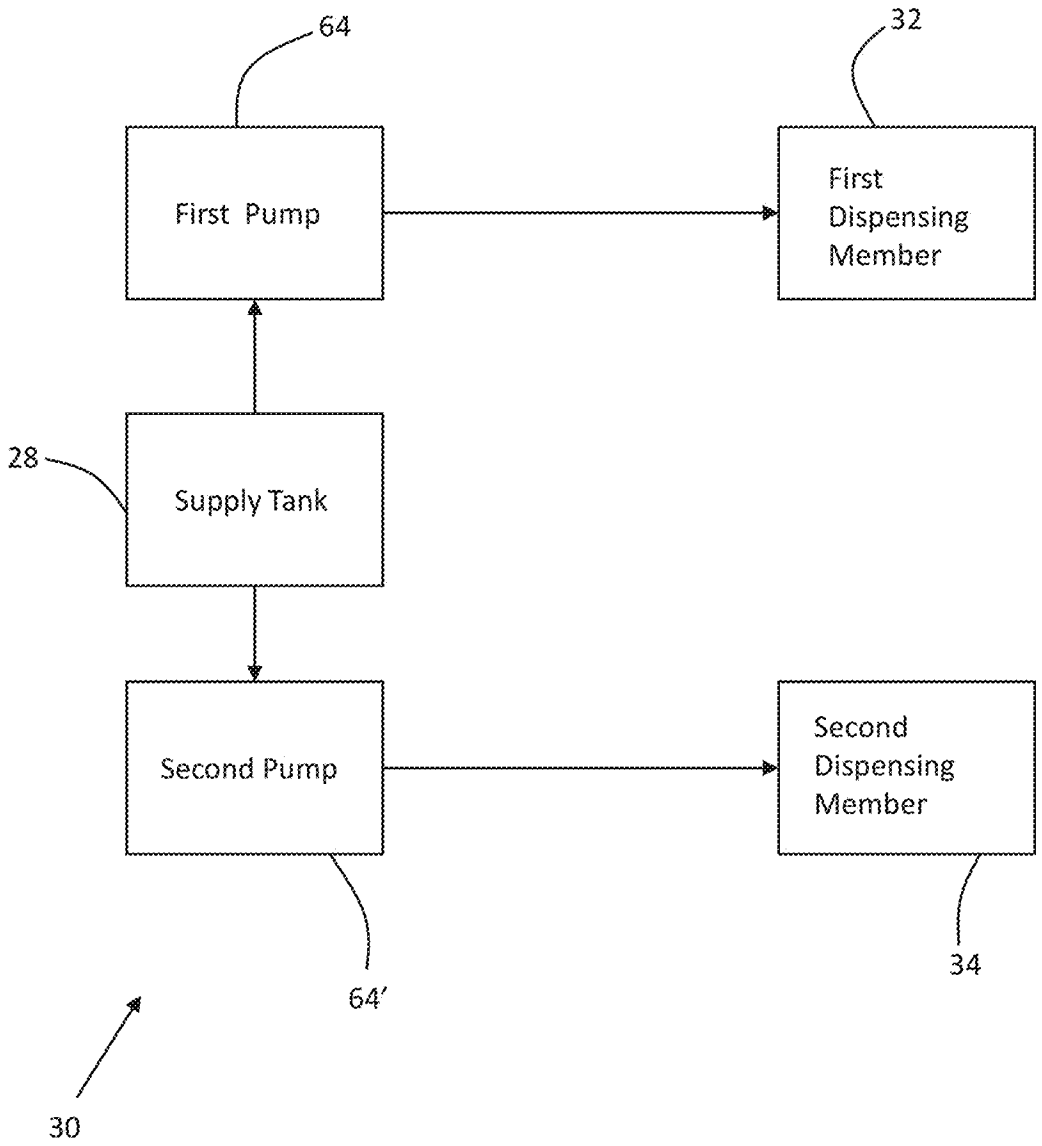
FIG. 9 is a schematic flow diagram of an alternative liquid distribution system of a floor cleaner.

In the embodiment shown schematically in FIG. 9, the floor cleaner 10 having two dispensing members can include a first pump 64 and a second pump 64' and no valve assembly. In this embodiment, the first pump 64 is fluidly coupled to the first dispensing member 32 to supply the cleaning fluid from the supply tank 28 to the first dispensing member 32. The first dispensing member 32 is configured to distribute the cleaning fluid in the first direction 40. The second pump 64' is fluidly coupled to the second dispensing member 34 to supply the cleaning fluid from the supply tank 28 to the second dispensing member 34. The second dispensing member 34 is configured to distribute the cleaning fluid in the second direction 42.

Figure 11:
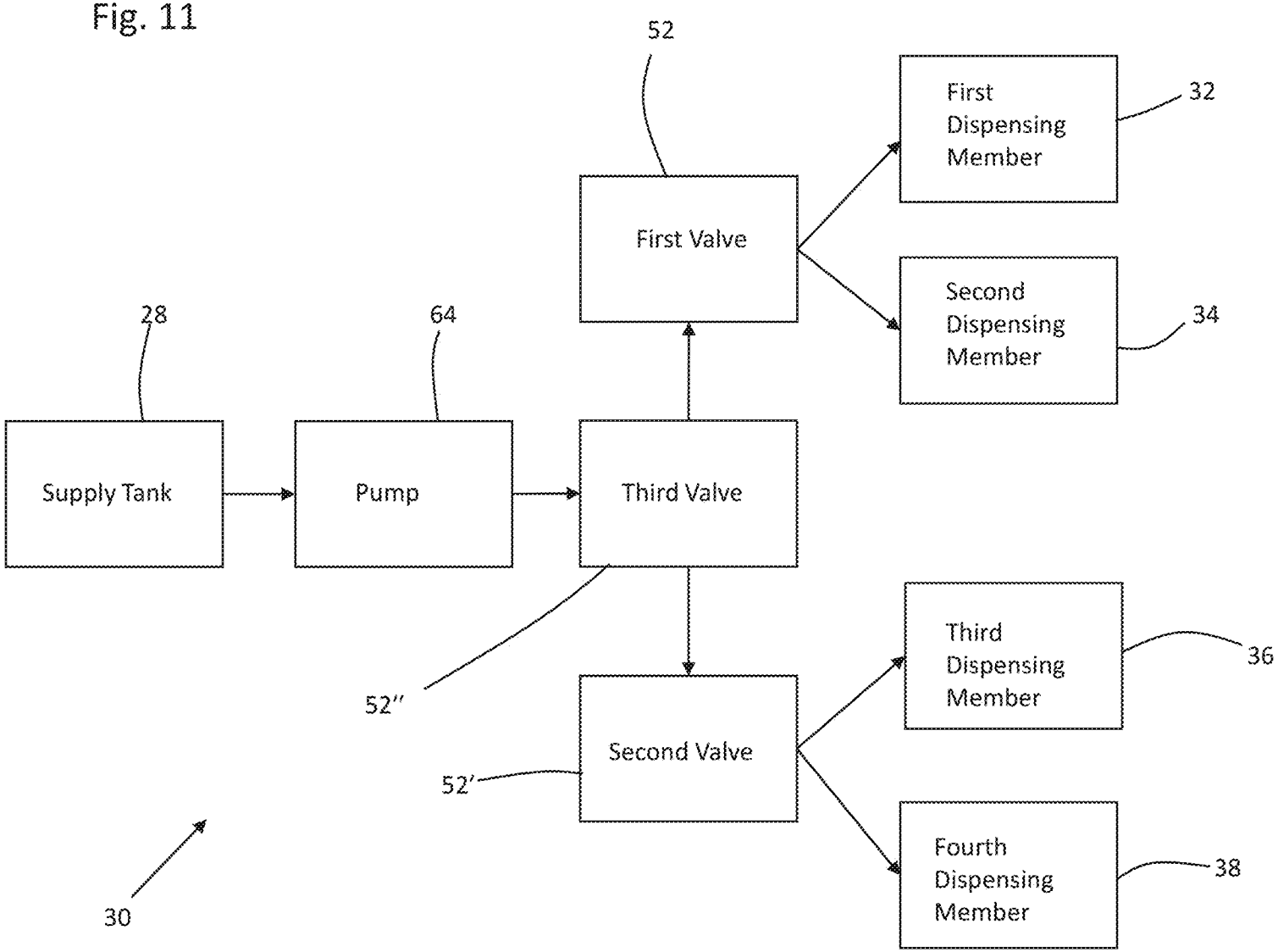
FIG. 11 is a schematic flow diagram of an alternative liquid distribution system of a floor cleaner.

In the embodiment illustrated in FIG. 11, the floor cleaner 10 having four dispensing members includes a first pump 64, the first dispensing member 32, the second dispensing member 34, the third dispensing member 36, the fourth dispensing member 38, the first valve 52, the second valve 52', and a third valve 52". The third valve 52" directs flow between the first and second valves 52, 52'. The first valve 52 directs flow between the first and second dispensing members 32, 34. The second valve 52' directs flow between the third and fourth dispensing members 36, 38.

Figure 12:
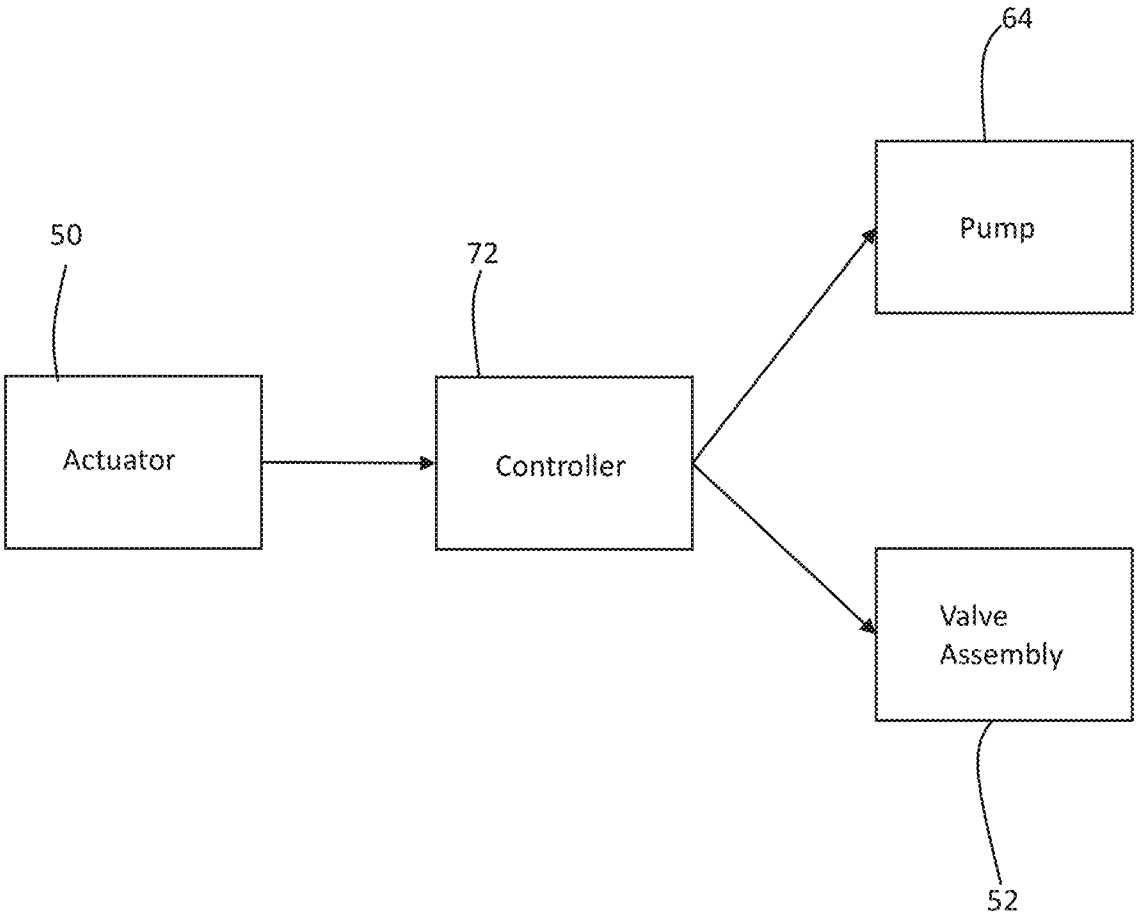
FIG. 12 is a schematic control diagram of a floor cleaner.

As schematically illustrated in FIG. 12, the controller 72 controls the flow of fluid through the fluid distribution system 30. The controller 72 receives an actuator signal from the actuator 50 when the user actuates the actuator 50 indicating desire for distributing fluid. The controller 72 receives the signal from the actuator 50 and in response sends a pump signal to the pump 64 to actuate the pump. In the embodiments having a valve assembly, schematically illustrated in FIGS. 8, 10, and 11, the controller simultaneously provides a valve signal to the valve assembly 52 to direct the valve into the valve first position or valve second position to divert flow to the selected dispensing member.

The fluid distribution system 30 is configured to distribute fluid to the surface to be cleaned in the first direction 40 and the second direction 42 based on the direction of movement of the cleaning head 14 across the surface to be cleaned. The fluid distribution system 30 may include the valve assembly 52 in fluid communication with the supply tank 28 and the first dispensing member 32 and the second dispensing member 34 for selectively delivering the solution to the first dispensing member 32 and the second dispensing member 34. In one embodiment, the fluid distribution system 30 allows distribution through the first dispensing member 32 when the floor cleaner 10 is moving in the first direction 40, and allows distribution of solution through the second dispensing member 34 when the cleaning head 14 is moving in the second direction 42. For example, the valve assembly 52 is movable between a first position in communication with the first dispensing member 32 when the body 12 is pivoted toward the second side 18 of the cleaning head, and a second position in communication with the second dispensing member 34 when the body 12 is pivoted toward the first side 16 of the cleaning head. In one embodiment, this is accomplished by a sensor to sense and determine the direction of movement of the cleaning head 14. In one embodiment, the sensor is a switch 54 in the body 12 or the cleaning head 14 that is physically actuated as a result of the user causing movement of the body 12 toward the first side 16, the second side 18, or one of the two lateral sides 20 and 20', the switch triggering the generation of a signal. The switch 54 is positioned to actuate sending a first sensor signal to the controller 72 when the body 12 is pivoted toward the second side 18 of the cleaning head 14. The switch 54 is positioned to actuate sending a second sensor signal to the controller 72 when the body 12 is pivoted toward the first side 16 of the cleaning head 14. In one embodiment, the switch 54 is in a pivot connection between the body 12 and the cleaning head 14. The controller 72 is configured to enable fluid distribution through the first dispensing member 32 when the controller receives the first sensor signal and enable fluid distribution through the second dispensing member 34 when the controller receives the second sensor signal to dispense in the direction of movement of the floor cleaner 10. In one embodiment, multiple switches are provided, schematically illustrated in FIG. 7, each corresponding to one dispensing member, wherein each switch is movable between an open position to allow fluid distribution through the corresponding dispensing member and a closed position to prevent fluid distribution, based on the direction of movement of the floor cleaner 10 and based on the assumption that the user is pushing the cleaning head 14 away from the recline direction of the body 12 and not pulling the cleaning head toward the recline direction of the body 12.

The sensor is operable to generate the signal based on the position of the body 12 relative to the cleaning head 14. The sensor generates the first sensor signal based on the body 12 being reclined toward the second side 18 of the cleaning head 14. The first sensor signal indicates that the body 12 of the floor cleaner 10 is oriented for user movement in the first direction 40, and the controller is configured to enable fluid distribution through the first dispensing member 32 when receiving the first sensor signal. The sensor generates the second sensor signal based the body 12 being reclined toward the first side 16 of the cleaning head 14. The second signal indicates that the body 12 is oriented for user movement in the second direction 42, and the controller is configured to enable fluid distribution through the second dispensing member 34 when receiving the second sensor signal. The sensor generates a third sensor signal based on the body 12 being reclined toward the lateral side 20' of the cleaning head 14. The third signal indicates the body 12 is oriented for user movement in the third direction 44, and the controller is configured to enable fluid distribution through the third dispensing member 36 when receiving the third sensor signal. Lastly, the sensor generates a fourth signal based on the body 12 being reclined toward the lateral side 20 of the cleaning head 14. The fourth signal indicates that the body 12 is oriented for user movement in the fourth direction 46, and the controller is configured to enable fluid distribution through the fourth dispensing member 38 when receiving the fourth sensor signal. The third signal and fourth signal are secondary to the first signal and second signal, such that if the body 12 is pivoted partially toward lateral side 20 or 20' and first side 16 or second side 18, the first signal or second signal will be dominant and enable fluid distribution through the first dispensing member 32 or the second dispensing member 34, respectively.

In one example, in response to detecting floor cleaner 10 movement in the first direction 40, the sensor generates the first sensor signal, which is transmitted to the controller 72. In response to receiving the first sensor signal, the controller 72 is configured to adjust the valve assembly 52 to allow distribution of solution in the first direction 40 through the first dispensing member 32. Upon receiving the actuator signal and the first sensor signal, the controller 72 sends the pump signal to the pump 64 and simultaneously sends the valve signal to actuate the valve assembly 52 to the first dispensing member 32.

In one embodiment, the sensor is a Hall Effect sensor. Movement of the body 12 relative to the cleaning head 14 causes movement of a magnetic component of the floor cleaner 10 to trigger a Hall Effect sensor for generation of the sensor signal. Based on the signal received, the controller actuates the fluid distribution system 30 to distribute liquid in the direction of forward movement, opposite the reclined position of the body 12.

In one embodiment, the sensor on the floor cleaner 10 is an accelerometer configured to determine direction of movement of the floor cleaner 10 on the surface. In one embodiment, the accelerometer is a single-axis accelerometer, and generates a first signal indicating the cleaning head 14 moving in the first direction 40, such as a forward direction, and a second signal indicating the cleaning head 14 moving in a second direction 42, such as a reverse direction. The controller controls the valve assembly 52 to distribute liquid through either the first dispensing member 32 or the second dispensing member 34, based on what signal is received from the accelerometer. In response to the first signal, the controller is operable to distribute fluid in the first direction 40 through the first dispensing member 32 and in response to the second signal, the controller is operable to distribute fluid in the second direction 42 through the second dispensing member 34. In one embodiment, the accelerometer is a two-axis accelerometer, and further generates a third signal indicating the cleaning head 14 movement in the third direction 44 and a fourth signal indicating the cleaning head 14 movement in the fourth direction 46. The controller 72 controls the valve assembly 52 to distribute liquid through the forward directed dispensing member based on the signal generated by the accelerometer. In an alternative example, the controller monitors the accelerometer signal or an integral of the accelerometer signal to determine when the floor cleaner 10 has stopped, for example when speed is zero. The controller may then stop distribution of liquid in response to determining that the floor cleaner 10 has stopped moving on the surface. Similarly, the controller may start the distribution of liquid in response to determining that the floor cleaner 10 has started moving on the surface. In one embodiment, the controller starts the distribution of liquid in response to the accelerometer determining that the floor cleaner 10 has started moving on the surface in combination with the actuator being actuated by the user.

In the embodiment shown schematically in FIG. 9, the controller is operatively connected the first pump 64 and the second pump 64'. The controller receives the signal from the sensor indicating the direction of movement of the floor cleaner 10. In response to receiving the first signal indicating floor cleaner 10 movement in the first direction 40, the controller activates the first pump 64 to distribute liquid to the first dispensing member 32 in the first direction 40, and the controller deactivates the second pump 64', preventing liquid distribution to the second dispensing member 34. When the controller receives the second signal indicating floor cleaner 10 movement in the second direction 42, the controller activates the second pump 64' to distribute liquid to the second dispensing member 34 in the second direction 42.

Figure 7:
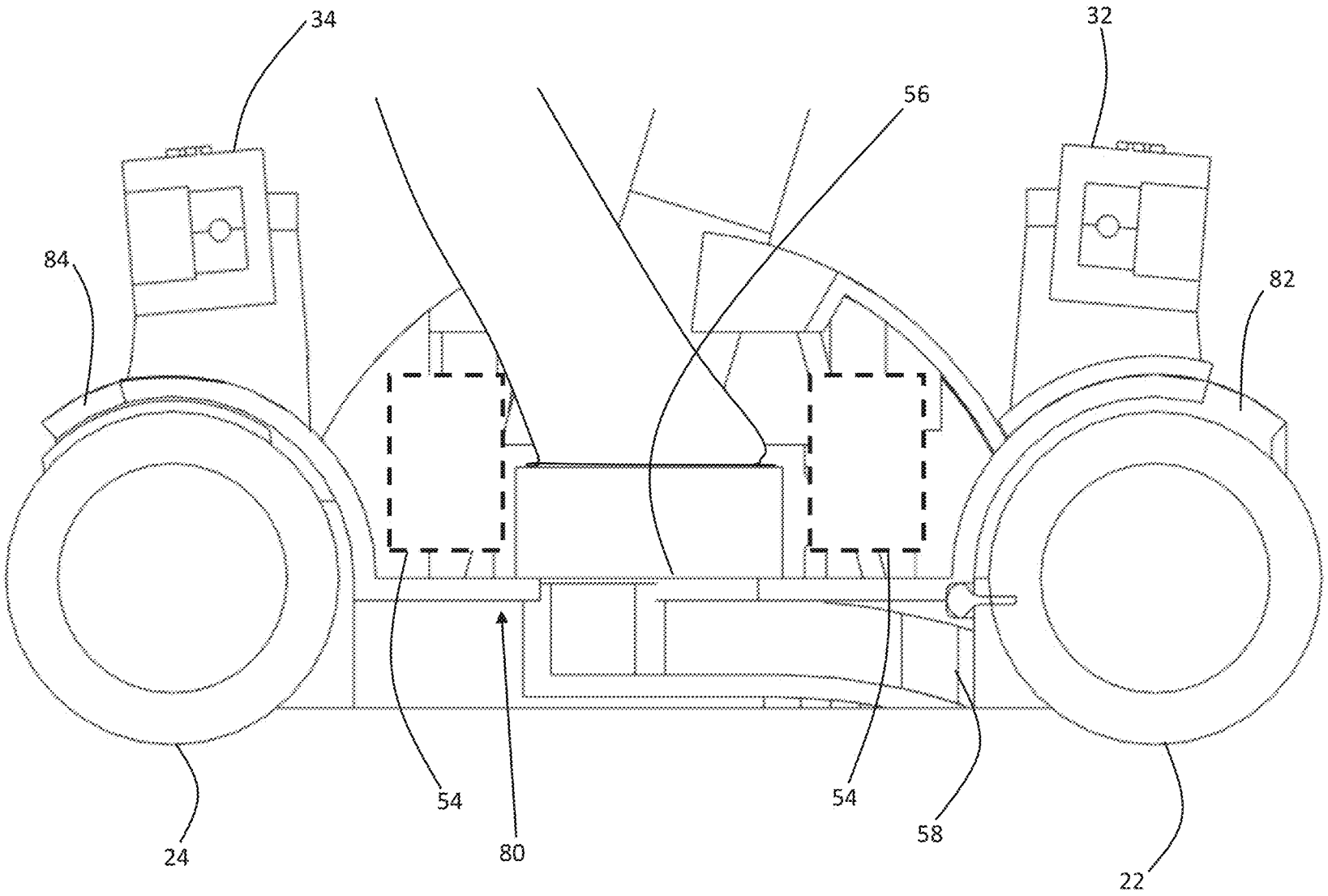
FIG. 7 is a cross-sectional detail view of the floor cleaner of FIG. 6.
Figure 7A:
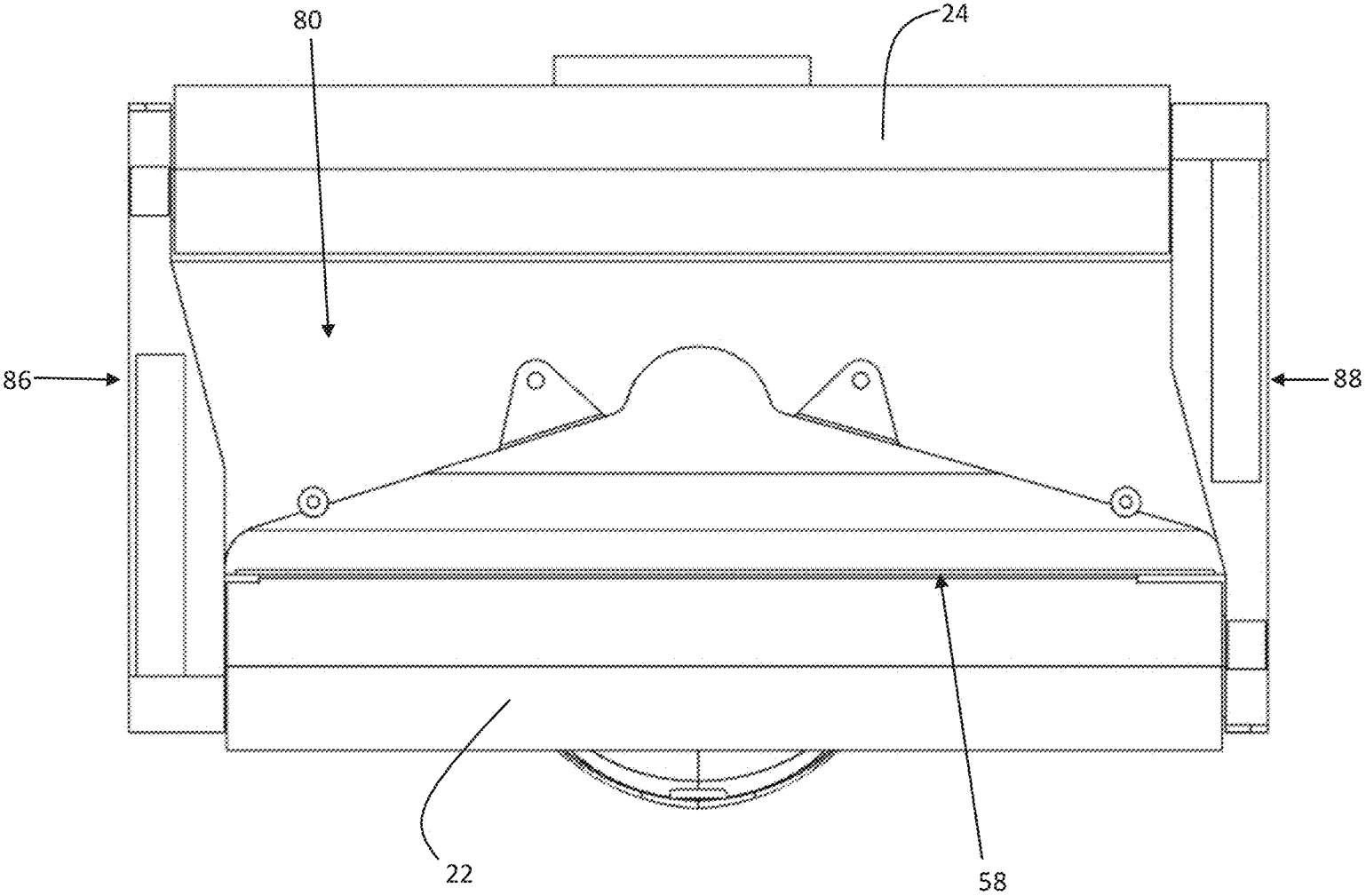
FIG. 7*a* is a bottom view of the floor cleaner of FIG. 7.

The cleaning head 14 further includes a housing 80. The housing 80 includes a front wall 82, a back wall 84, a first sidewall 86 bounding a first end of the first and second cleaning rollers 22, 24, and a second sidewall 88 bounding a second end of the first and second cleaning rollers 22, 24. The front wall 82 and the back wall 84 extend to at least partially cover the first cleaning roller 22 and the second cleaning roller 24 (FIG. 7). The front wall 82 forms a first roller cover disposed along a first radius around at least a portion of the first cleaning roller 22. The back wall 84 forms a second roller cover disposed along a second radius around at least a portion of the second cleaning roller 24. In the illustrated embodiment, the first cleaning roller 22 is a cylindrical roller having a first cleaning roller radius. The second cleaning roller 24 is a cylindrical roller having a second cleaning roller radius. The first roller cover radius is between 75% and 125% of the first cleaning roller radius. In one embodiment, the first roller cover radius is from 75% to 100% of the first cleaning roller radius such that there is contact or interference between the roller and the housing. The first cleaning roller 22 and the second cleaning roller 24 may be microfiber, tufted bristles, bristle strips, wipers, or other similar cleaning materials. The first cleaning roller 22 and the second cleaning roller 24 may be made of the same or different material. In another embodiment, the first roller cover radius is between 100% and 125% such that there is a gap between the roller and the housing. The second roller cover radius is between 75% and 125% of the second cleaning roller radius. In one embodiment, the second roller cover radius is from 75% to 100% of the second cleaning roller radius such that there is contact or interference between the roller and the housing. In another embodiment, the second roller cover radius is between 100% and 125% such that there is a gap between the roller and the housing. Stated another way, the roller covers may have contacting interference with the cleaning rollers, or may be spaced away from the cleaning rollers as desired for the embodiment. In one embodiment, the cleaning housing 80 includes a wiper disposed above the nozzle inlet opening The floor cleaner 10 further includes a suction source 60, a suction nozzle 56 in fluid communication with the suction source 60, and a recovery reservoir 48 in fluid communication with the suction source 60 and the suction nozzle 56. During operation, the liquid distribution system 30 distributes cleaning solution to the surface, while the floor cleaner 10 substantially simultaneously extracts and recovers the applied cleaning solution in a continuous operation. The applied cleaning solution is extracted from the surface by the suction nozzle 56. In the illustrated embodiment, the nozzle 56 has an inlet 58 at least partially spanning the first cleaning roller 22. In one embodiment, the housing 80 includes a wiper positioned above the suction nozzle inlet 58 and extending along and engaging the first cleaning roller 22. The wiper is configured to remove fluid from the cleaning roller. The suction nozzle 56 is in fluid flow communication with the recovery reservoir 48 by way of an air duct. The suction source 56, such as a motor and fan assembly (not shown), is housed in the body 12 and draws air through the nozzle 56, through the recovery reservoir 48 to then exhaust the air to the external atmosphere. In other embodiments, the suction source 60 may be alternatively housed in a different portion of the floor cleaner 10, such as the cleaning head 14. In one embodiment, the suction nozzle 56 is disposed between the first cleaning roller 22 and the second cleaning roller 24. The suction nozzle 56 has an inlet 58 opening extending longitudinally along the first cleaning roller 22. The inlet 58 extends horizontally and faces the first cleaning roller 22 (FIG. 7*a*). In one embodiment, the inlet 58 extends between 50% and 100% the length of the first cleaning roller 22. A drive assembly 26 is operatively connected and configured to rotate at least one of the first cleaning roller 22 and the second cleaning roller 24. In one embodiment, the drive assembly 26 is operatively connected to the first cleaning roller 22 to rotate the first cleaning roller in a first direction 90. The floor cleaner 10 may further include a second drive assembly operatively connected to the second cleaning roller to rotate the second cleaning roller in a second direction 92, opposite the first direction 90. In one embodiment, the first cleaning roller 22 and the second cleaning roller 24 rotate in the same direction. In the embodiment illustrated in FIG. 7*a*, the first cleaning roller 22 and the second cleaning roller 24 are driven from opposite ends. The first and second cleaning rollers are axially offset to improve edge cleaning.

The recovery reservoir 48 includes an air and liquid separator (not shown), such as one or more baffles or other separator as is understood by one skilled in the art, for separating the liquid (i.e., the recovered cleaning fluid) from the air entering the recovery reservoir and recovering the separated liquid in the recovery reservoir. The recovery reservoir 48 is removably coupled to the body 12 to allow a user to remove the recovery reservoir 48 and empty the liquid contents. In other embodiments, the recovery reservoir 48 may be operatively coupled to one or more other portions of the floor cleaner, such as the cleaning head 14.

Various features and advantages of the invention are set forth in the following claims.

What is claimed is:

1. A floor cleaner comprising:

a body;

a cleaning head pivotably coupled to the body, the cleaning head including a first side, a second side, a first lateral side, and a second lateral side, the first and second lateral sides extending between the first side and the second side, the body is pivotable with respect to the cleaning head about a first axis extending between the first and second lateral sides of the cleaning head and the body is pivotable with respect to the cleaning head about a second axis toward the first lateral side and toward the second lateral side, a cleaning member disposed in the cleaning head and configured to contact a surface to be cleaned; and a liquid distribution system including a supply tank a first dispensing member in fluid communication with the supply tank and configured to dispense solution in a first direction and beyond the first side of the cleaning head onto the surface to be cleaned, a second dispensing member in fluid communication with the supply tank and configured to dispense solution in a second direction and beyond the first lateral side of the cleaning head onto the surface to be cleaned; and a valve in fluid communication with the first dispensing member and the second dispensing member, wherein the valve is configured to selectively deliver solution to the first dispensing member and prevent delivery of solution to the second dispensing member in response to pivoting of the body relative to the cleaning head about the first axis and configured to selectively deliver solution to the second dispensing member and prevent delivery of solution to the first dispensing member in response to pivoting of the body relative to the cleaning head about the second axis.

2. The floor cleaner of claim 1, wherein when the body is pivoted about the second axis the floor cleaner is movable across the surface to be cleaned in the first lateral direction and the second lateral direction and the second dispensing member is configured to dispense fluid when the cleaning head moves in the first lateral direction.

3. The floor cleaner of claim 1, wherein when the body is pivoted about the first axis the floor cleaner is movable across the surface in a first direction and a second direction opposite the first direction and the first dispensing member is configured to dispense fluid when the cleaning head moves in the first direction.

4. The floor cleaner of claim 1, wherein the body includes a connecting member coupled to the cleaning head for rotation about the first axis and wherein an upper portion of the body is coupled to the connecting member for pivoting movement about the second axis.

5. The floor cleaner of claim 1, further comprising a controller and a sensor, wherein the sensor is configured to generate a signal based on a position of the body relative to the cleaning head, and wherein the controller determines a direction of movement based on the signal and the controller operates the valve in response to the direction of movement.

6. The floor cleaner of claim 5, wherein when the body is pivoted about the second axis toward the second lateral side, the sensor generates the signal and the controller determines the direction of movement is in a lateral direction based on the signal.

7. The floor cleaner of claim 6, wherein the controller selectively enables fluid distribution through the second dispensing member when the controller receives the signal.

8. The floor cleaner of claim 6, wherein the valve includes a valve body and a valve member and wherein the controller is operable to actuate the valve member to move to a first position relative to the valve body to deliver solution to the second dispensing member in response to the signal, and wherein, in the first position, delivery of solution to the first dispensing member is inhibited by the valve member.

9. The floor cleaner of claim 5, wherein the sensor is a Hall Effect sensor and movement of the body relative to the cleaning head causes movement of a magnetic component relative to the Hall Effect sensor to generate the signal.

10. The floor cleaner of claim 1, wherein the liquid distribution system further comprises an actuator, and a pump coupled between the supply tank and the valve, and wherein the pump is configured to selectively pump solution through the valve based on input from the actuator.

11. The floor cleaner of claim 1, further comprising a controller and a switch, and wherein the switch is physically actuated upon pivoting movement of the body with respect to the head, and wherein the switch is configured to generate a signal when actuated, and wherein the controller determines a direction of movement based on the signal and the controller operates the valve in response to the direction of movement.

12. A floor cleaner comprising:

a body;

a cleaning head pivotably coupled to the body and movable across a surface to be cleaned in a first direction, a second direction opposite the first direction, a first lateral direction, and a second lateral direction opposite the first lateral direction;

a cleaning roller disposed in the cleaning head;

a liquid distribution system including a supply tank a first dispensing member in fluid communication with the supply tank and configured to dispense solution beyond the cleaning head onto the surface to be cleaned in the first direction, a second dispensing member in fluid communication with the supply tank and configured to dispense solution beyond the cleaning head onto the surface to be cleaned in the first lateral direction; and a valve in fluid communication with the first dispensing member and the second dispensing member for alternately selectively delivering the solution to the first dispensing member and selectively delivering the solution to the second dispensing member in response to pivoting of the body relative to the cleaning head, wherein when the valve delivers solution to the first dispensing member it prevents solution from being delivered to the second dispensing member and wherein when the valve delivers solution to the second dispensing member it prevents solution from being delivered to the first dispensing member;

wherein the valve is configured to deliver solution to the first dispensing member when the cleaning head moves in the first direction and the valve is configured to deliver solution to the second dispensing member when the cleaning head moves in the first lateral direction.

13. The floor cleaner of claim 12, further comprising a controller and a sensor, wherein the sensor is configured to generate a signal based on a direction of movement of the floor cleaner along the surface to be cleaned.

14. The floor cleaner of claim 13, wherein when the direction of movement is in the first lateral direction the sensor generates a first signal, and wherein the controller selectively enables fluid distribution through the first dispensing member in response to the first signal.

15. The floor cleaner of claim 14, wherein the valve includes a valve body and a valve member movable relative to the valve body between a first position allowing fluid distribution to the first dispensing member, and a second position allowing fluid distribution to the second dispensing member.

16. The floor cleaner of claim 15, wherein the controller is operable to actuate the valve member to move to the first position to deliver solution to the first dispensing member in response to the first signal, and wherein, in the first position, delivery of solution to the second dispensing member is inhibited by the valve member.

17. The floor cleaner of claim 13, wherein the sensor is an accelerometer and generates a first signal indicating the direction of movement is in the first direction and a second signal indicating the direction of movement is in the first lateral direction.

18. The floor cleaner of claim 13, wherein the sensor is a switch that is physically actuated when the body is pivoted with respect to the head to indicate a direction of movement of the cleaning head across the surface to be cleaned.

19. The floor cleaner of claim 12, wherein the first dispensing member is positioned on the cleaning head adjacent a first side of the cleaning head to dispense solution beyond the first side of the cleaning head and the second dispensing member is positioned on the cleaning head adjacent a first lateral side of the cleaning head to dispense solution beyond the first lateral side of the cleaning head.

20. The floor cleaner of claim 12, further comprising a pump and an actuator operably coupled with the pump, wherein the pump is configured to selectively pump solution through the valve based on input from the actuator.

* * * * *